US009973853B2

(12) United States Patent
Zhang et al.

(10) Patent No.: US 9,973,853 B2
(45) Date of Patent: May 15, 2018

(54) FIXED APPARATUS AND AUDIO COLLECTION APPARATUS

(71) Applicant: Scenes Sound Digital Technology (Shenzhen) Co., Ltd, Shenzhen (CN)

(72) Inventors: Ruibo Zhang, Shenzhen (CN); Hui Lin, Shenzhen (CN); Dan Xiao, Shenzhen (CN); Fang Wenbin, Shenzhen (CN)

(73) Assignee: Scenes Sound Digital Technology (Shenzhen) Co., Ltd., Shenzhen (CN)

( * ) Notice: Subject to any disclaimer, the term of this patent is extended or adjusted under 35 U.S.C. 154(b) by 0 days. days.

(21) Appl. No.: 15/474,110

(22) Filed: Mar. 30, 2017

(65) Prior Publication Data

US 2018/0048961 A1 Feb. 15, 2018

Related U.S. Application Data

(63) Continuation of application No. PCT/CN2016/094776, filed on Aug. 12, 2016.

(51) Int. Cl.
*H04R 5/027* (2006.01)

(52) U.S. Cl.
CPC ..... *H04R 5/027* (2013.01); *H04R 2201/401* (2013.01)

(58) Field of Classification Search
CPC ..... H04R 5/027; H04R 5/04; H04S 7/303; H04S 2400/15; H04S 2420/01
See application file for complete search history.

(56) References Cited

U.S. PATENT DOCUMENTS 4,119,798 A * 10/1978 Iwahara ..... H04S 3/002 381/19
4,308,426 A * 12/1981 Kikuchi ..... H04R 5/027 181/129

* cited by examiner

*Primary Examiner* — Sonia Gay
(74) *Attorney, Agent, or Firm* — Ladas & Parry LLP

(57) ABSTRACT

The present invention is applicable to the field of audio collection and provides a fixed apparatus and an audio collection device. Multiple groups of simulated ear structures are disposed on the fixed apparatus, and the simulated ear structures have simulated ear canal openings used for placing audio collectors. The audio collectors may placed in simulated ear canal openings of the simulated ear structures of the fixed apparatus, so that collected audio signals have richer sources, higher quality, and higher stereoscopic sensation. The fixed apparatus may be used for audio recording in multiple orientations, so that smoothness, clearness, and comfort during sound field fusion and switching are ensured, more complete and richer sound field information is collected, the best sound field naturalness can be obtained, and a requirement for synchronization between a sound and an image in a VR panoramic video technology is met. In addition, a volume of the fixed apparatus is relatively small, and audio sound field restoration accuracy is further improved.

10 Claims, 3 Drawing Sheets

FIXED APPARATUS AND AUDIO COLLECTION APPARATUS

This application is a continuation application of PCT Patent Application No. PCT/CN2016/094776.

TECHNICAL FIELD

The present invention belongs to the field of audio collection, and particularly, relates to a fixed apparatus and an audio collection apparatus.

BACKGROUND

With the development and popularization of a virtual reality (VR) panoramic video technology, a visual angle of a picture is changed by means of head tracking, so that a visual system and a motion perception system of a user are connected, and the user can observe a presented scene through head motion. A VR panoramic video device enables the user to watch a video at any visual angle within 360 degrees. In order to bring stereo perception experience to users by using the VR panoramic video technology, an audio recording technology in a panoramic video also becomes a focus, and how to record audio that can be synchronous with an image becomes an important research topic.

In the VR panoramic video technology, in order to achieve a verisimilar hearing effect, in a video playing process, an image in each direction requires audio that is recorded in the corresponding direction. If there is no corresponding audio recording mechanism, when a user faces a certain direction, heard sounds are possibly sounds recorded when the user faces another direction, and stereo experience of synchronization between an image and a sound in the VR panoramic video technology cannot be truly experienced. However, an existing audio recording device usually performs recoding at a point by using an omni-directional microphone, a sound is single in source and has flat and non-stereoscopic tone quality, or only audio in four directions: front, back, left, and right are picked up. During watch of a VR panoramic video, an average transition angle for turning from a sound field in one direction to a sound field in another direction in a human head rotation process is 90 degrees. Therefore, a span is relatively large, that is, a fusion band is relatively large, a match effect with an image is poor, and a requirement for synchronization between a sound and an image in the VR panoramic video technology cannot be met.

SUMMARY

Embodiments of the present invention provide a fixed apparatus and aims to resolve a problem that an existing audio recording device cannot synchronize a sound and an image in a VR panoramic video technology.

The embodiments of the present invention are implemented in the following manner:

A fixed apparatus is provided, where multiple groups of simulated ear structures are disposed on the fixed apparatus, and the simulated ear structures have simulated ear canal openings used for placing audio collectors.

The embodiments of the present invention further provide an audio collection device, including:

the fixed apparatus in the foregoing embodiment; and audio collectors placed in simulated ear canal openings of the fixed apparatus.

The fixed apparatus provided in the embodiments of the present invention has multiple pairs of simulated ear structures. Audio collectors may be placed in simulated ear canal openings of the simulated ear structures of the fixed apparatus, so that collected audio signals have richer sources, higher quality, and higher stereoscopic sensation, and audio recording in multiple orientations ensures smoothness, clearness, and comfort during sound field fusion and switching, more complete and richer sound field information is collected, the best sound field naturalness can be obtained, and a requirement for synchronization between a sound and an image in a VR panoramic video technology is met. In addition, a volume of the fixed apparatus is relatively small, and audio sound field restoration accuracy is further improved.

DESCRIPTION OF EMBODIMENTS

To make the objectives, technical solutions and advantages of the present invention clearer and more comprehensible, the following further describes the present invention in detail with reference to the accompanying drawings and embodiments. It should be understood that the specific embodiments described herein are merely used to explain the present invention but are not intended to limit the present invention.

According to the embodiments of the present invention, audio collectors may be disposed on a fixed apparatus with multiple pairs of simulated ear structures, so that collected audio signals have richer sources, higher quality, and higher stereoscopic sensation, and audio recording in multiple orientations completely meets a requirement for synchronization between a sound and an image in a VR panoramic video technology.

In the following, specific implementation of the present invention is described in detail with reference to specific embodiments.

Figure 1:
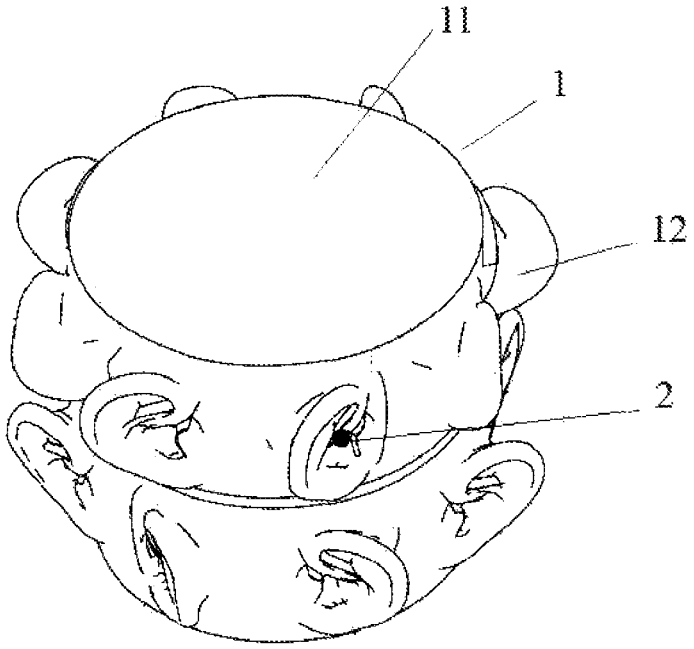
FIG. 1 is a schematic structural diagram of a fixed apparatus on which audio collectors are placed according to an embodiment of the present invention.

As shown in FIG. 1, in an embodiment of the present invention, a fixed apparatus 1 is applied to an audio collection device, The audio collection device includes the fixed apparatus 1 and audio collectors 2. The audio collector 2 is configured to collect an audio signal and may be an audio component such as a microphone, and the fixed apparatus 1 is configured to place the audio collectors 2.

In this embodiment of the present invention, multiple groups of simulated ear structures 12 are disposed on the fixed apparatus 1, and the simulated ear structures 12 have simulated ear canal openings used for placing the audio collectors.

In an embodiment of the present invention, the fixed apparatus 1 includes two fixed layers 11 at which the simulated ear structures 12 are arranged.

In an embodiment of the present invention, the two fixed layers 11 are of an integrally formed structure. It may be understood that that the integrally formed structure of the two fixed layers 11 of the fixed apparatus 1 may mean that multiple groups of simulated ear structures 12 are disposed in each of two areas of the fixed apparatus 1, and the two areas exactly form an arrangement manner of an upper layer and a lower layer on the fixed apparatus 1.

In another embodiment of the present invention, the two fixed layers 11 of the fixed apparatus 1 may be two fixed structures connected in a detachable mode, and a connection manner may be magnetic suction connection, mortise and tenon connection, buckle connection, stick connection, welding or threaded connection, or the like.

In an embodiment of the present invention, the simulated. ear structures 12 and the fixed apparatus 1 may be of an integrally formed structure, or the simulated ear structures 12 are connected to the fixed apparatus 1 in a detachable manner. For example, the fixed apparatus 1 is a mechanical structure such as a holder and is connected to the simulated ear structures 12 in a mechanical connection manner, and the detachable connection manner facilitates replacement and device adjustment.

Figure 2:
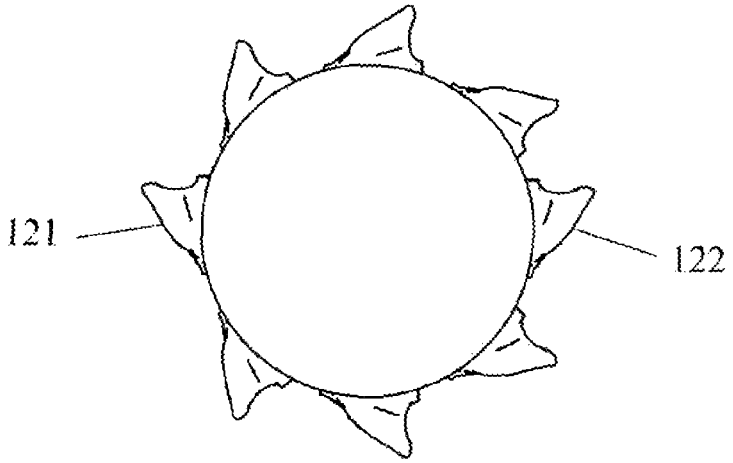
FIG. 2 is a top view of a fixed layer of a fixed apparatus according to an embodiment of the present invention.

As shown in FIG. 2, in an embodiment of the present invention, each group of simulated ear structures 12 includes a simulated right ear structure 121 and a simulated left ear structure 122, and the simulated right ear structure 121 and the simulated left ear structure 122 are arranged on the fixed apparatus 1 in a paired manner, It may be understood that the simulated ear structure 12 may be a simulated human ear model or a human ear model that has been dimmed and simplified. The simulated human ear model can make a collected audio signal more precise and more targeted, and the human ear model that has been dimmed and simplified makes a contour close to an average level by reducing personal features, so as to improve integral applicability.

It may be understood that the simulated left ear structure 122 and the simulated right ear structure 121 include simulated auricles, simulated external ears, simulated ear canal openings, and the like. A mechanism of transmitting sounds to the audio collectors 2 through the simulated auricles, the simulated external ears, and the simulated ear canal openings of the simulated ear structures 12 is similar to a. process of conducting a sound to an ear drum through human ears; that is, the device can simulate an effect of reflecting and diffracting sound waves by human auricles, ear canals, the human skull, and the like, so that the audio collectors 2 arranged in the ear canal openings can collect verisimilar audio information that is highly consistent with natural sounds heard by the human ears, the sounds are rich in quality, and stereoscopic sensation and authenticity of the sounds are ensured.

Figure 3:
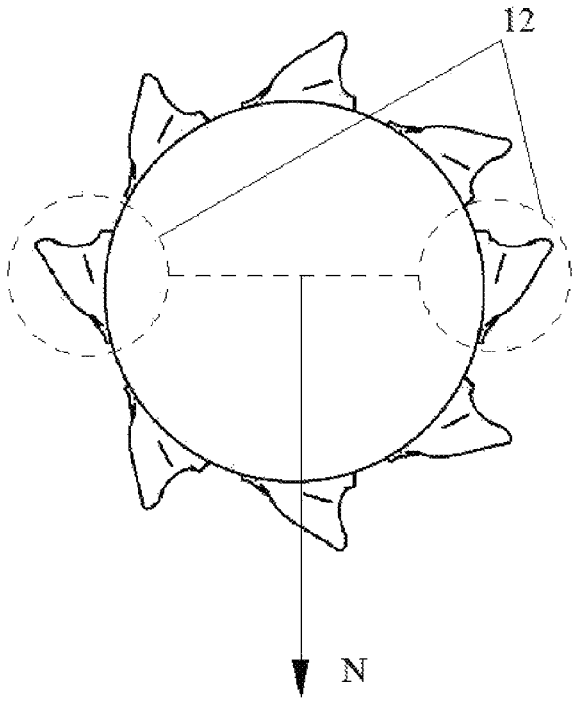
FIG. 3 is a schematic diagram of a position relationship between virtual face orientations and simulated ear structures according to an embodiment of the present invention.

As shown in FIG. 3, in an embodiment of the present invention, each group of simulated ear structures 12 corresponds to one virtual face orientation N, a position relationship between human ears and a human face orientation of a human head is simulated in a position relationship of the simulated ear structures 12 and the corresponding virtual face orientations N, and the pairs of simulated ear structures 12 have different virtual face orientations N, so as to collect audio signals in different directions. In this audio recording manner, audio signals in multiple directions can be obtained, so as to meet a requirement for a VR panora.mic video.

In an embodiment of the present invention, K groups of simulated ear structures 12 are disposed at each fixed layer 11, where $2 \leq K \leq 4$. Correspondingly, the fixed apparatus 1 has 4 to 8 groups of simulated ear structures. In detail, when a human ear hears a sound, the sound may be positioned, a general orientation of a sound source is formed in the brain, and a virtual image is formed. During VR panoramic video watching, a user needs to correspondingly turn his face according to scene switching in a video to follow an image in the video. In a conventional audio recording technology, only one or one group of fixed audio collectors is used to collect sounds, and therefore, during VR panoramic video watching, the user can sense only in a certain direction that the image is corresponding to the virtual image funned by sound positioning of the brain. When a user's face turns to another direction, because no audio is recorded in the corresponding direction, a virtual image formed by sound positioning of the user's brain is not corresponding to an image observed by means of vision, and a perception disorder is caused.

In the audio collection device according to the present invention, multiple groups of simulated ear structures 12 are disposed on a fixed apparatus 1, so that sounds in multiple directions can be collected, sound sources are richer, audio recording in multiple orientations can meet a requirement for synchronization between a sound and an image in a VR panoramic video technology, and best experience is brought to users who pursue high-quality audio and experience of being personally on the scene.

In an embodiment of the present invention, K is 4; that is, when 4 groups of simulated ear structures 12 are disposed at each fixed layer 11, there are 8 groups of simulated ear structures 12 on the fixed apparatus 1.

In an embodiment of the present invention, on the fixed apparatus 1, virtual face orientations of any two pairs of simulated ear structures 12 are staggered with each other in a horizontal direction at an included angle of M times of 45 degrees, where $M \geq 1$. The virtual face orientations of the simulated ear structures 12 may be set flexibly, so that each fixed layer 11 can be used for collecting audio signals in 4 different directions.

Figure 4:
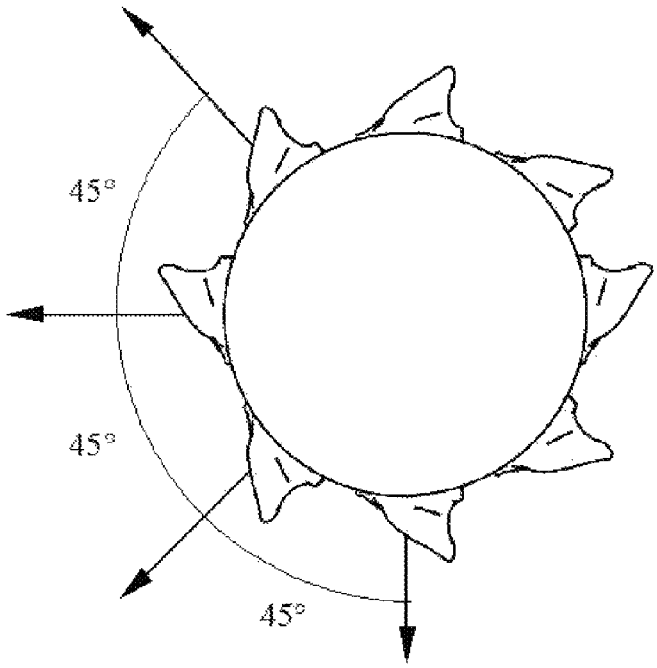
FIG. 4 is a schematic diagram of arrangement of simulated ear structures at a fixed layer according to an embodiment of the present invention.

In a preferred embodiment of the present invention, as shown in FIG. 4, at each fixed layer 11, virtual face orientations of 4 groups of simulated ear structures 12 are sequentially staggered in the horizontal direction at an included angle of 45 degrees.

Figure 5:
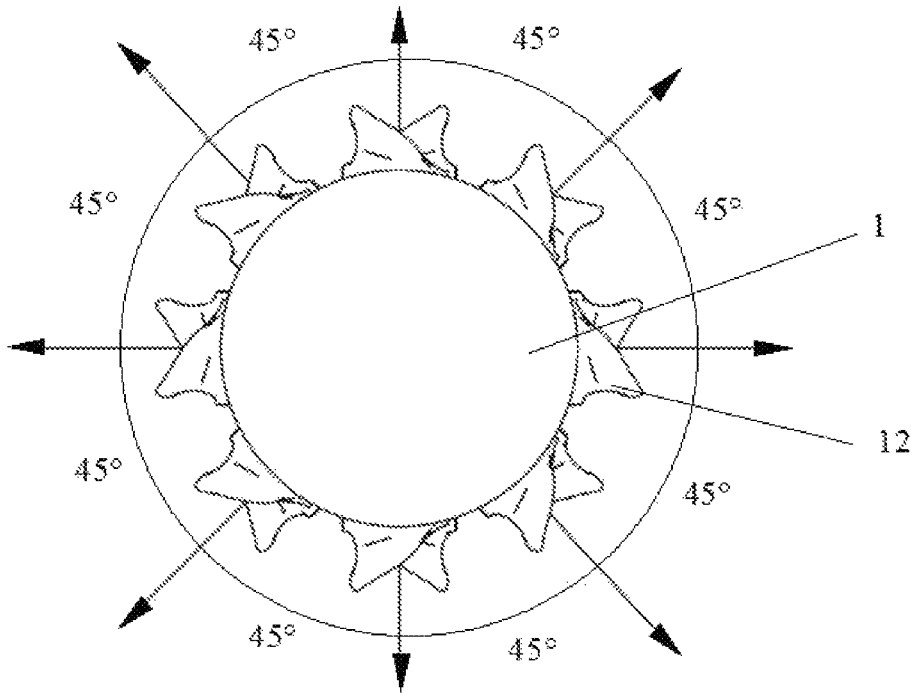
FIG. 5 is a schematic diagram of arrangement of simulated ear structures on a fixed apparatus according to an embodiment of the present invention.

As shown in FIG. 5, the fixed apparatus 1 is formed by stacking two fixed layers 11, and includes 8 groups of simulated ear structures 12. Face orientations of the 8 groups of simulated ear structures 12 are sequentially staggered in the horizontal direction at an included angle of 45 degrees. In this way, the audio collection device can collect sound fields in 8 directions in the horizontal direction, an included angle between two neighboring directions is 45 degrees, and therefore, a fusion band of the sound fields is 45 degrees; that is, during VR video playing, an average transition angle for turning from a sound field in one direction to a sound. field in another direction in a human head rotation process is 45 degrees, smoothness, clearness, and comfort during sound field fusion and switching are ensured, more complete and richer sound field information is collected, and the best sound field naturalness can be obtained.

Multiple groups of simulated ear structures are disposed on the fixed apparatus provided in the embodiment of the present invention, and the simulated ear structures have simulated ear canal openings used for placing audio collectors. The audio collectors are disposed on the fixed apparatus with the multiple pairs of simulated ear structures, so that collected audio signals have richer sources, higher quality, and higher stereoscopic sensation, and audio recording in multiple orientations completely meets a requirement for synchronization between a sound and an image in a VR panoramic video technology, and best experience is brought to users who pursue high-quality audio and experience of being personally on the scene. In addition, when 8 groups of simulated ear structures are disposed on the fixed apparatus, sound fields in 8 directions can be collected, a sound field fusion band is reduced from average 90 degrees to 45 degrees, smoothness, clearness, and comfort during sound field fusion and switching are ensured, more complete and richer sound field information is collected, and the best sound field naturalness can be achieved. According to this solution, a volume is reduced to an optimal size while it is ensured that maximum panoramic sound field information integrity is collected, a volume of the device is ensured, and sound field restoration accuracy can be improved.

The audio collection device provided in the embodiment of the present invention includes audio collectors and a fixed apparatus. Multiple groups of simulated ear structures are disposed on the fixed apparatus, and the simulated ear structures have simulated ear canal openings used for placing the audio collectors. The audio collectors are disposed on the fixed apparatus with the multiple pairs of simulated ear structures, so that collected audio signals have richer sources, higher quality, and higher stereoscopic sensation, and audio recording in multiple orientations completely meets a requirement for synchronization between a sound and an image in a VR panoramic video technology, and best experience is brought to users who pursue high-quality audio and experience of being personally on the scene. In addition, when 8 groups of simulated ear structures are disposed in the fixed apparatus, the device can collect sound fields in 8 directions, a sound field fusion band is reduced from average 90 degrees to 45 degrees, smoothness, clearness, and comfort during sound field fusion and switching are ensured, more complete and richer sound field information is collected, and the best sound field naturalness can be obtained. According to this solution, a volume is reduced to an optimal size while it is ensured that maximum panoramic sound field information integrity is collected, a volume of the device is ensured, and sound field restoration accuracy can be improved.

The foregoing descriptions are merely preferred embodiments of the present invention, but are not intended to limit the present invention. Any modification, equivalent replacement, improvement, and the like made within the spirit and principle of the present invention shall fall within the protection scope of the present invention.

The invention claimed is:

1. A fixed apparatus, wherein multiple groups of simulated ear structures are disposed on the fixed apparatus, the fixed apparatus comprises two fixed layers at which the simulated ear structures are arranged, and the two fixed layers are of an integrally formed structure or two fixed structures connected in a detachable manner;

the multiple groups comprise K groups of simulated ear structures disposed at each of the fixed layers, and $2 \leq K \leq 4$;

and the simulated ear structures have simulated ear canal openings used for placing audio collectors, wherein each group of simulated ear structures comprises a simulated left ear structure and a simulated right ear structure and corresponds to a virtual face orientation, a position relationship between human ears and a human face orientation of a human head is simulated in a position relationship between the simulated ear structures and the corresponding virtual face orientations, and the groups of simulated ear structures have different virtual face orientations.

2. The fixed apparatus according to claim 1, wherein K is 4.

3. The fixed apparatus according to claim 2, wherein virtual face orientations of any two groups of simulated ear structures of the fixed apparatus are staggered with each other in a horizontal direction at an included angle of M times of 45 degrees, and $M \geq 1$.

4. The fixed apparatus according to claim 2, wherein virtual face orientations of 4 groups of simulated ear structures at each of the fixed layers are sequentially staggered in a horizontal direction at an included angle of 45 degrees.

5. The fixed apparatus according to claim 2, wherein face orientations of 8 groups of simulated ear structures of the fixed apparatus are sequentially staggered in a horizontal direction at an included angle of 45 degrees.

6. An audio collection device, comprising:

fixed apparatus, wherein multiple groups of simulated ear structures are disposed on the fixed apparatus, wherein:

the fixed apparatus comprises two fixed layers at which the simulated ear structures are arranged, and the two fixed layers are of an integrally formed structure or two fixed structures connected in a detachable manner;

the multiple groups comprise K groups of simulated ear structures disposed at each of the fixed layers, and $2 \leq K \leq 4$; and the simulated ear structures have simulated ear canal openings used for placing audio collectors wherein each group of simulated ear structures comprises a simulated left ear structure and a simulated right ear structure and corresponds to a virtual face orientation, a position relationship between human ears and a human face orientation of a human head is simulated in a position relationship between the simulated ear structures and the corresponding virtual face orientations, and the groups of simulated ear structures have different virtual face orientations;

and audio collectors placed in simulated ear canal openings of the fixed apparatus.

7. The audio collection device according to claim 6, wherein K is 4.

8. The audio collection device according to claim 7, wherein virtual face orientations of any two groups of simulated ear structures of the fixed apparatus are staggered with each other in a horizontal direction at an included angle of M times of 45 degrees, and $M \geq 1$.

9. The audio collection device according to claim 7, wherein virtual face orientations of 4 groups of simulated ear structures at each of the fixed layers are sequentially staggered in a horizontal direction at an included angle of 45 degrees.

10. The audio collection device according to claim 7, wherein face orientations of 8 groups of simulated ear structures of the fixed apparatus are sequentially staggered in a horizontal direction at an included angle of 45 degrees.

* * * * *